US010988952B2

(12) United States Patent
Hou et al.

(10) Patent No.: US 10,988,952 B2
(45) Date of Patent: Apr. 27, 2021

(54) BUCKLING-RESTRAINED BRACE CONTAINING L-SHAPED ENERGY DISSIPATION ELEMENT, BUILDING AND ASSEMBLY METHOD

(71) Applicant: SHANDONG UNIVERSITY, Shandong (CN)

(72) Inventors: Hetao Hou, Jinan (CN); Shaoyuan Zhang, Jinan (CN); Zhihao Du, Jinan (CN); Xiang Han, Jinan (CN); Chunxue Dai, Jinan (CN)

(73) Assignee: SHANDONG UNIVERSITY, Shandong (CN)

( * ) Notice: Subject to any disclaimer, the term of this patent is extended or adjusted under 35 U.S.C. 154(b) by 24 days.

(21) Appl. No.: 16/488,830

(22) PCT Filed: Jun. 26, 2018

(86) PCT No.: PCT/CN2018/092742

§ 371 (c)(1),
(2) Date: Aug. 26, 2019

(87) PCT Pub. No.: WO2019/019850

PCT Pub. Date: Jan. 31, 2019

(65) Prior Publication Data

US 2020/0362585 A1 Nov. 19, 2020

(30) Foreign Application Priority Data

Jul. 25, 2017 (CN) ..... 201710610892.0
Jul. 25, 2017 (CN) ..... 201720905586.5

(51) Int. Cl.
*E04H 9/02* (2006.01)

(52) U.S. Cl.
CPC ..... *E04H 9/021* (2013.01)

(58) Field of Classification Search
CPC ..... E04B 1/98; E04B 2001/2442; E04H 9/02; E04H 9/027; E04H 9/021; E04G 25/04; E04C 2003/026
See application file for complete search history.

(56) References Cited

U.S. PATENT DOCUMENTS 8,763,320 B1 * 7/2014 Chou ..... E04C 3/00 52/167.3
2006/0253057 A1 * 11/2006 Qi ..... E04C 3/04 602/23

(Continued)

FOREIGN PATENT DOCUMENTS

CN 201377126 Y 1/2010
CN 201687219 U 12/2010

(Continued)

OTHER PUBLICATIONS

Aug. 29, 2018 Search Report issued in International Patent Application No. PCT/CN2018/092742.

(Continued)

*Primary Examiner* — Christine T Cajilig
(74) *Attorney, Agent, or Firm* — Oliff PLC

(57) ABSTRACT

A buckling-restrained brace includes a telescopic inner restrained member, an outer restrained member sleeved outside the inner restrained member and the L-shaped energy dissipation element between the inner restrained member and the outer restrained member; the inner restrained member includes a first steel square tube and a second steel square tube which are connected by insertion; the L-shaped energy dissipation element includes four L-shaped fuses, and two ends of the four L-shaped fuses are connected to the four right-angle sides of the first steel square tube and the second steel square tube by bolts, respectively; and the inner section of the outer restrained member is square, the outer restrained member covers the (Continued)

L-shaped energy dissipation element, and a certain gap is disposed between the outer restrained member and the L-shaped energy dissipation element. The buckling-restrained brace is simple to disassemble and replace, and the buckling-restrained members are convenient to reuse.

18 Claims, 9 Drawing Sheets

(56) References Cited

U.S. PATENT DOCUMENTS

| | | | | |
|---|---|---|---|---|
| 2008/0016794 | A1* | 1/2008 | Tremblay | E04H 9/0237 52/167.4 |
| 2013/0139452 | A1* | 6/2013 | Tsai | E04B 1/98 52/167.3 |
| 2017/0016504 | A1* | 1/2017 | Braun | F16F 7/128 |
| 2017/0067249 | A1 | 3/2017 | Matteson | |

FOREIGN PATENT DOCUMENTS

| | | | | |
|---|---|---|---|---|
| CN | 202416619 | U | 9/2012 | |
| CN | 204626690 | U | 9/2015 | |
| CN | 107288399 | A | 10/2017 | |
| CN | 206957320 | U | 2/2018 | |
| WO | WO-2016068401 | A1 * | 5/2016 | E04B 1/38 |
| WO | WO-2017054323 | A1 * | 4/2017 | E04H 9/02 |

OTHER PUBLICATIONS

Aug. 29, 2018 Written Opinion of the International Searching Authority issued in International Patent Application No. PCT/CN2018/092742.

* cited by examiner

BUCKLING-RESTRAINED BRACE CONTAINING L-SHAPED ENERGY DISSIPATION ELEMENT, BUILDING AND ASSEMBLY METHOD

FIELD OF THE INVENTION

The present invention relates to the technical field of external force resisting members of structural engineering, in particular to a buckling-restrained brace with an L-shaped energy dissipation element, a building and an assembly method.

BACKGROUND OF THE INVENTION

In a multistoried or high-rise building steel structure system, a frame is the most basic unit. A brace enables the steel frame to have higher lateral resisting stiffness and strength, so as to reduce the lateral displacement of the frame during earthquake and avoid or reduce the damage to non-structural members. A buckling-restrained brace overcomes the shortcoming of compressive buckling of the common braces, and offers enhanced energy dissipation capability, reduced difference in tensile and compression resistances and ease of computer modeling.

After the 1994 Northridge Earthquake and the 1995 Kobe Earthquake, the use of buckling-restrained brace substantially increased in new buildings and seismic retrofits of existing construction. Moreover, various types of high-performance buckling-restrained brace have been proposed. However, the existing types of ordinary buckling-restrained brace have the following limitations:

1) Cumbersome disassembly and replacement: an energy dissipation element of the buckling-restrained brace needs to dissipate energy from an earthquake. The energy dissipation will inevitably cause damage or rupture of the energy-dissipation element, so the energy dissipation-seismic effect of the buckling-restrained brace may be greatly compromised in the aftershocks or subsequent earthquakes. For the existing buckling-restrained brace, in particular to the buckling-restrained brace using mortar or other brittle non-metallic filling material filled in steel tubes to realize a buckling-restrained mechanism, after a major earthquake, if the damage to the energy dissipation element needs to be detected, an outer restrained member needs to be disassembled, which is troublesome to operate and can also cause the damage to the brace. Even if special technical means prove that it is necessary to replace the damaged buckling-restrained brace, the removal of the existing buckling-restrained brace and the installation of the new buckling-restrained brace may be onerous for many reasons, for example, limited workspace at the buckling-restrained brace ends, especially when a gusset plate connecting the buckling-restrained brace to the frame is completely or partially obscured by ceilings or other non-structural members. In addition, many existing common buckling-restrained braces are connected with the gusset plates of the connecting frames through welding seams, so that it is necessary to apply secondary welding to the gusset plates for replacing the whole braces. It is difficult to perform the secondary welding and ensure the quality. Furthermore, the thermal effect generated by welding can affect the mechanical properties of the gusset plates and reduce the bearing capacity and fatigue performance of the new braces.

2) Poor recyclability: a buckling-restrained brace with reasonable design should control the damage within the constrained yielding segments of the energy dissipation element, while the buckling-restrained members should always remain elastic. However, the buckling-restrained members in many traditional buckling-restrained braces are very low in reusability, which does not help achieving the sustainable design objects.

SUMMARY OF THE INVENTION

The present invention discloses a buckling-restrained brace with an L-shaped energy dissipation element which is simple to disassemble and replace and can reuse buckling-restrained members conveniently, a building and an assembly method.

In order to solve the above technical problems, the present invention provides the following technical solution:

In one aspect, the present invention discloses a buckling-restrained brace with an L-shaped energy dissipation element, which is used as a brace for a frame structure and includes a telescopic inner restrained member, an outer restrained member sleeved outside the inner restrained member and the L-shaped energy dissipation element between the inner restrained member and the outer restrained member, wherein, the inner restrained member includes a first steel square tube and a second steel square tube with the same length and outer section size, the first steel square tube and the second steel square tube are connected by insertion, and the ends of the first steel square tube and the second steel square tube are connected with the frame structure; the L-shaped energy dissipation element includes four L-shaped fuses, and two ends of the four L-shaped fuses are connected to the four right-angle sides of the first steel square tube and the second steel square tube by bolts, two slots/notches are formed in the middle part of each of the L-shaped fuses for forming weakened yielding segments, and the two ends are non-weakened non-yielding segments; and the inner section of the outer restrained member is square, the outer restrained member covers the L-shaped energy dissipation element, and a certain gap is disposed between the outer restrained member and the L-shaped energy dissipation element. Further, the first steel square tube and the second steel square tube have the same size, the first steel square tube and the second steel square tube are connected by a male-male adaptor, the male-male adaptor is a steel square tube, stiffeners which are arranged outside surface and perpendicular to the planes of the steel square tubes are arranged at the middle part of the male-male adaptor, the outer section size of the male-male adaptor is smaller than the inner section size of the first steel square tube, one end of the male-male adaptor is welded or plugged into the first steel square tube, and the other end is plugged into the second steel square tube.

Further, each of the first steel square tube and the second steel square tube is 100-5000 mm long, the spacing between the first steel square tube and the second steel square tube is 20-500 mm, the gap between the outside surface of the male-male adaptor and the inside surface of the second steel square tube is 1-10 mm, and of the male-male adaptor plugged into the second steel square tube is 20-800 mm long. Further, bolt holes for connection with the first steel square tube and the second steel square tube are formed in the outer side parts of the non-yielding segments, the non-yielding section includes an unrestrained connecting segment provided with the bolt holes, an unrestrained non-yielding segment not provided with the bolt holes and not covered with the outer restrained member and a restrained non-yielding segment not provided with the bolt holes but covered with the outer restrained member, the outer restrained member covers the yielding segments and the restrained non-yielding segments, and the yielding segments are restrained yielding segments restrained by the inner restrained member and the outer restrained member.

Further, lifting pieces used for lifting the outer restrained member are fixedly arranged at the unrestrained non-yielding section in the lower parts of the L-shaped fuses; the non-weakened non-yielding segments are arranged at the middle parts of the L-shaped fuses for forming middle restrained non-yielding segments, and the length of each of the middle restrained non-yielding segments is greater than the spacing between the first steel square tube and the second steel square tube when the buckling-restrained brace deforms due to a maximum design tension capacity.

Further, the outer restrained member is formed by buckling four W-shaped steel plates, and the adjacent W-shaped steel plates are connected by the bolts;

or, the outer restrained member is formed by connecting two U-shaped steel plates which open in the same direction by the bolts;

or, the outer restrained member includes two U-shaped steel plates which are arranged opposite with each other and open in the opposite direction, and two steel plates are connected to the side faces of the U-shaped steel plates by the bolts;

or, the outer restrained member is formed by buckling two U-shaped steel plates, and the two U-shaped steel plates are connected by the bolts.

Further, the gap between the outer restrained member and the L-shaped energy dissipation element is 1-5 mm, and a debonding material is filled in the gap.

Further, transition regions between the adjacent two sections of the restrained non-yielding segments, the restrained yielding segments and the middle restrained non-yielding segments are arc lines, straight lines or a combination thereof.

In a further aspect, the present invention provides a building, including the above buckling-restrained brace with the L-shaped energy dissipation element.

In still a further aspect, the present invention further provides an assembly method of the above buckling-restrained brace with the L-shaped energy dissipation element, including:

step 1: welding or plugging one end of the male-male adaptor to or into the first steel square tube, and inserting the other end into the second steel square tube to form the inner restrained member;

step 2: adjusting the spacing between the first steel square tube and the second steel square tube, and connecting the unrestrained connecting segments of the L-shaped energy dissipation element to the right-angle sides of each of the first steel square tube and the second steel square tube by the bolts;

step 3: covering the L-shaped energy dissipation element by the outer restrained member, and connecting the components of the outer restrained member by the bolts.

The present invention has the following beneficial effects:

Compared with the prior art, in the buckling-restrained brace with the L-shaped energy dissipation element of the present invention, two ends of the four L-shaped fuses on the L-shaped energy dissipation element are respectively connected to the four right-angle sides of each of the first steel square tube and the second steel square tube of the inner restrained member by bolts so as to be convenient to install and disassemble. The damage is concentrated at the yielding segments of the L-shaped fuses, the inner restrained member and the outer restrained member still remain elastic after an earthquake and can be reused, only the L-shaped fuses need to be replaced, and then the buckling-restrained brace can restore its energy dissipation function.

DETAILED DESCRIPTION OF THE EMBODIMENTS

In order to enable the technical problems, the technical solutions, and the advantages of the present invention to be clearer, the present invention will be described in detail in conjunction with the drawings and the specific embodiments.

Figure 8:
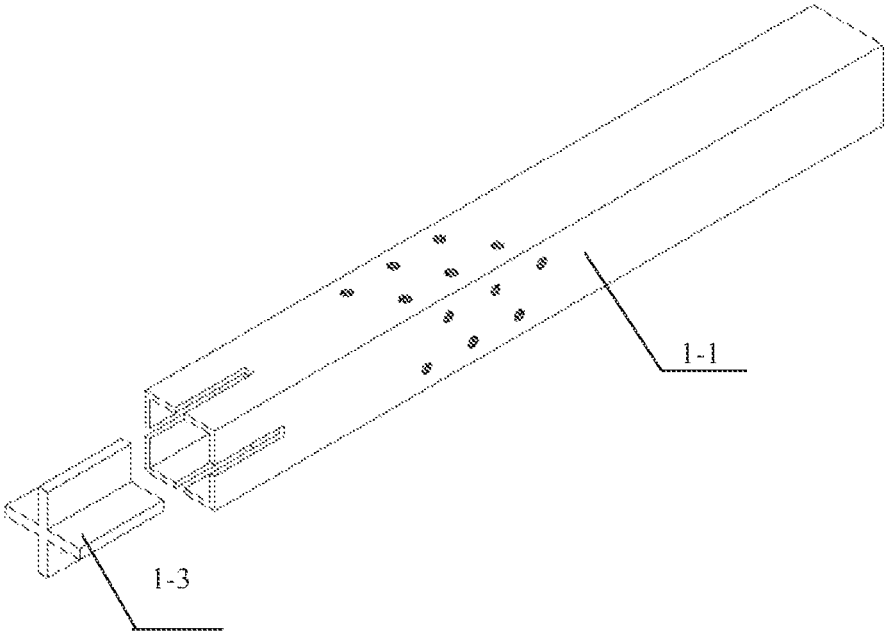
FIG. 8 is a schematic view illustrating the structure of a first steel square tube of the inner restrained member of the present invention.

In one aspect, the present invention discloses a buckling-restrained brace with an L-shaped energy dissipation element, which is used as a brace for a frame structure (as shown in FIG. 1 to FIG. 15). The buckling-restrained brace comprises a telescopic inner restrained member 1, an outer restrained member 2 sleeved outside the inner restrained member 1 and the L-shaped energy dissipation element between the inner restrained member 1 and the outer restrained member 2, wherein, the inner restrained member 1 comprises a first steel square tube 1-1 and a second steel square tube 1-2 with the same length and outer section size, the first steel square tube 1-1 and the second steel square tube 1-2 are connected by insertion, the ends of the first steel square tube 1-1 and the second steel square tube 1-2 which are away from each other are connected with the frame structure, specifically, elongated slots can be formed all around the outer ends of the first steel square tube 1-1 or the second steel square tube 1-2 and connected with gusset plates of the frame structure through connecting plates 1-3 or directly, as shown in FIG. 8, the section of each of the connecting plates 1-3 is crisscross, the crisscross connecting plates 1-3 are welded at the outer ends of the first steel square tube 1-1 and the second steel square tube 1-2, the first steel square tube 1-1 and the second steel square tube 1-2 of the inner restrained member 1 can move relatively in the axial direction of the brace; after the installation, it needs to be ensured that when the buckling-restrained brace deforms due to a maximum design compressive resistance, the near ends with the same outer section size of the first steel square tube 1-1 and the second steel square tube 1-2 are not in contact with each other, and when it deforms by a maximum design tension capacity, the near ends of the first steel square tube 1-1 and the second steel square tube 1-2 cannot depart from each other; it is worth noting that under the condition of tensile and compressive forces, the first steel square tube 1-1 and the second steel square tube 1-2 can also be rectangular tubes or the steel tubes in other segment shapes; those skilled in the art can select flexibly without affecting the inventiveness of the present invention; and in addition, the maximum design tensile/compression resistance of the present invention is designed by those skilled in the art according to the loading features of the specific frame structure.

The L-shaped energy dissipation element includes four L-shaped fuses 3, and two ends of the four L-shaped fuses 3 are connected to the four right-angle sides of the first steel square tube 1-1 and the second steel square tube 1-2 by bolts respectively; the bolts here can be blind hole bolts meeting the design requirements or high-strength bolts with screw rods long enough; the cross section of each of the L-shaped fuses 3 is L-shaped and can be formed by cutting profile steel or formed by cold-bending cut steel plates without welding, which reduces the initial defects of energy dissipation elements and is beneficial for giving full play to the performance of steel products. When the first steel square tube 1-1 and the second steel square tube 1-2 on the L-shaped fuses 3 are connected by bolts, the bolts here can be blind hole bolts meeting the design requirements or high-strength bolts with sufficiently long screw rods, or the like; bolt holes are formed in the first steel square tube 1-1 and the second steel square tube 1-2 according to design positions and sizes; on the same side, the bolt holes can be arranged in parallel or staggered, openings of the bolt holes can neither cause the mutual influence of the bolts, nor affect the relative motion of the first steel square tube 1-1 and the second steel square tube 1-2, the openings in the two parallel sides can be arranged in the same way the openings in the two perpendicular sides can be staggered, and the specific arrangement can be determined according to the actually adopted bolts.

Two alots/notches 4 are formed in the middle part of each of the L-shaped fuses 3 for forming weakened yielding segments 3-1, and two ends of the L-shaped fuses are non-weakened non-yielding segments 3-2;

the inner section of the outer restrained member 2 is square, the outer restrained member covers the L-shaped energy dissipation element, and a certain gap is disposed between the outer restrained member 2 and the L-shaped energy dissipation element. Compared with the prior art, in the buckling-restrained brace with the L-shaped energy dissipation element of the present invention, two ends of the four L-shaped fuses on the L-shaped energy dissipation element are respectively connected to the four right-angle sides of each of the first steel square tube and the second steel square tube of the inner restrained member by bolts so as to be convenient to install and disassemble as well as to replace the L-shaped energy dissipation element after an earthquake. During replacing process, it only needs to connect new L-shaped fuses to the inner restrained member by bolts without welding. When the buckling-restrained brace with the L-shaped energy dissipation element is installed, the first steel square tube and the second steel square tube of the inner restrained member are connected by insertion, then the four L-shaped fuses are connected on the four right-angle sides of the first steel square tube and the second steel square tube by the bolts, and finally, the outer restrained member covers the L-shaped fuses. When in tension or compression, the damage can be concentrated at the yielding segments of the L-shaped fuses, the inner restrained member and the outer restrained member still remain elastic after an earthquake and can be reused, only the L-shaped fuses need to be replaced, and then the energy dissipation-seismic function of the buckling-restrained brace can be restored.

Figure 1:
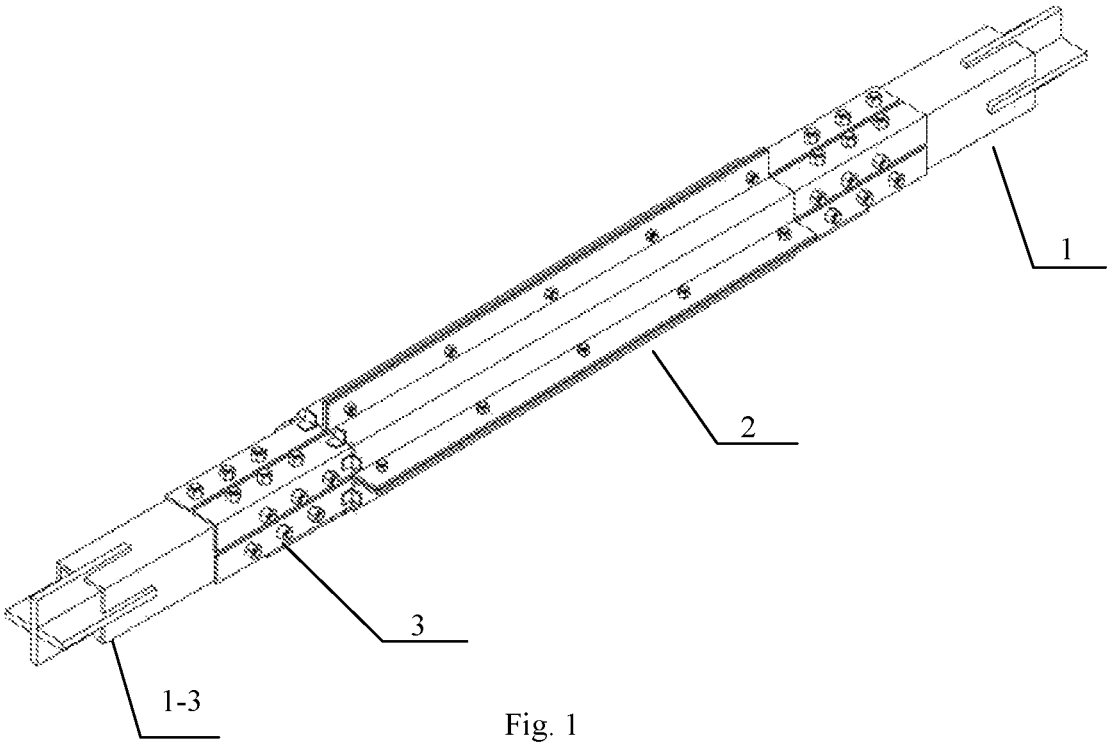
FIG. 1 is a schematic view illustrating the overall structure of a buckling-restrained brace with an L-shaped energy dissipation element of the present invention.
Figure 2:
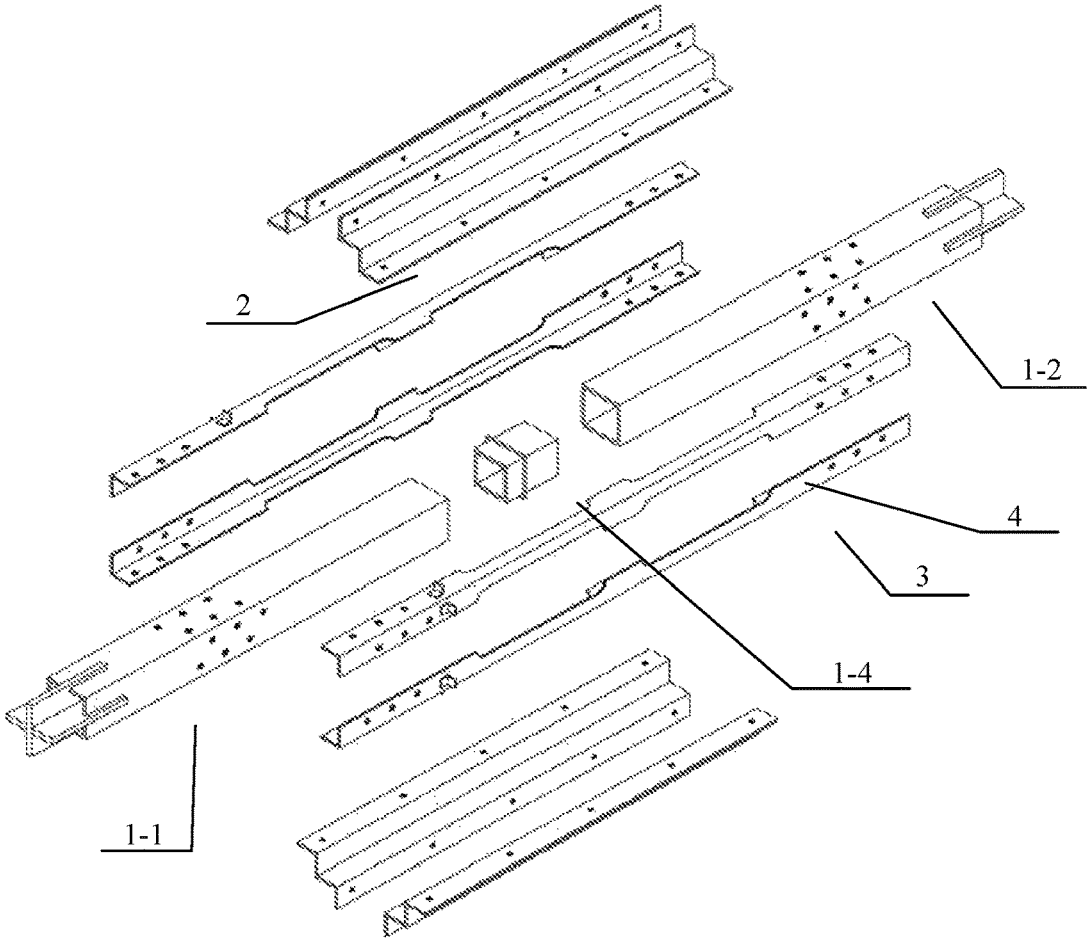
FIG. 2 is an explored view illustrating the components of the buckling-restrained brace with the L-shaped energy dissipation element of the present invention.
Figure 3:
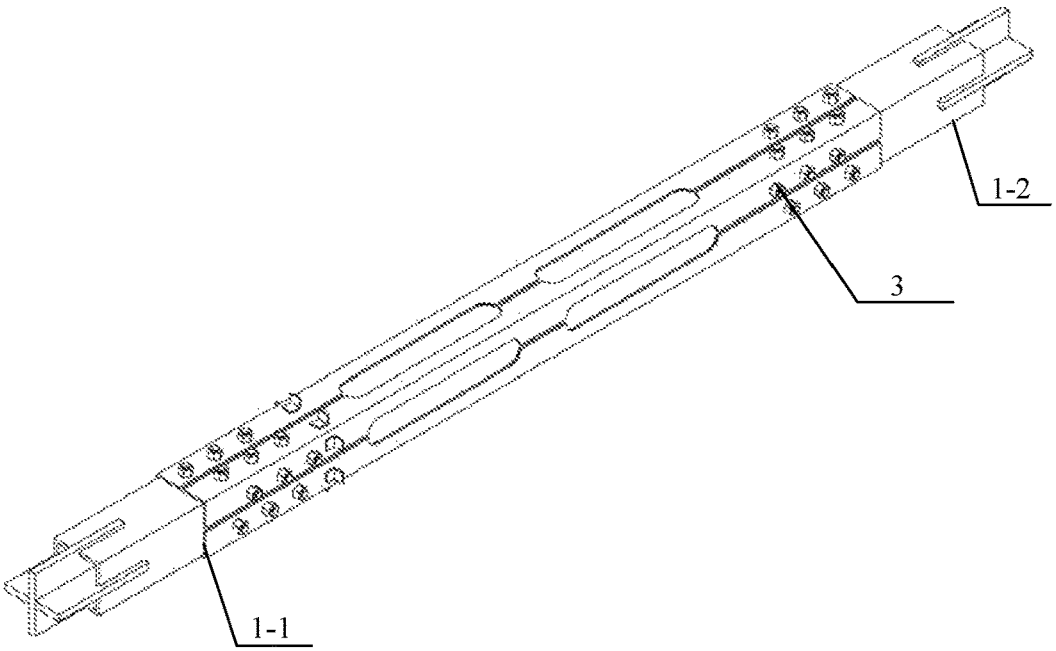
FIG. 3 is a schematic view illustrating the connection between the L-shaped energy dissipation element and an inner restrained member of the present invention.
Figure 4:
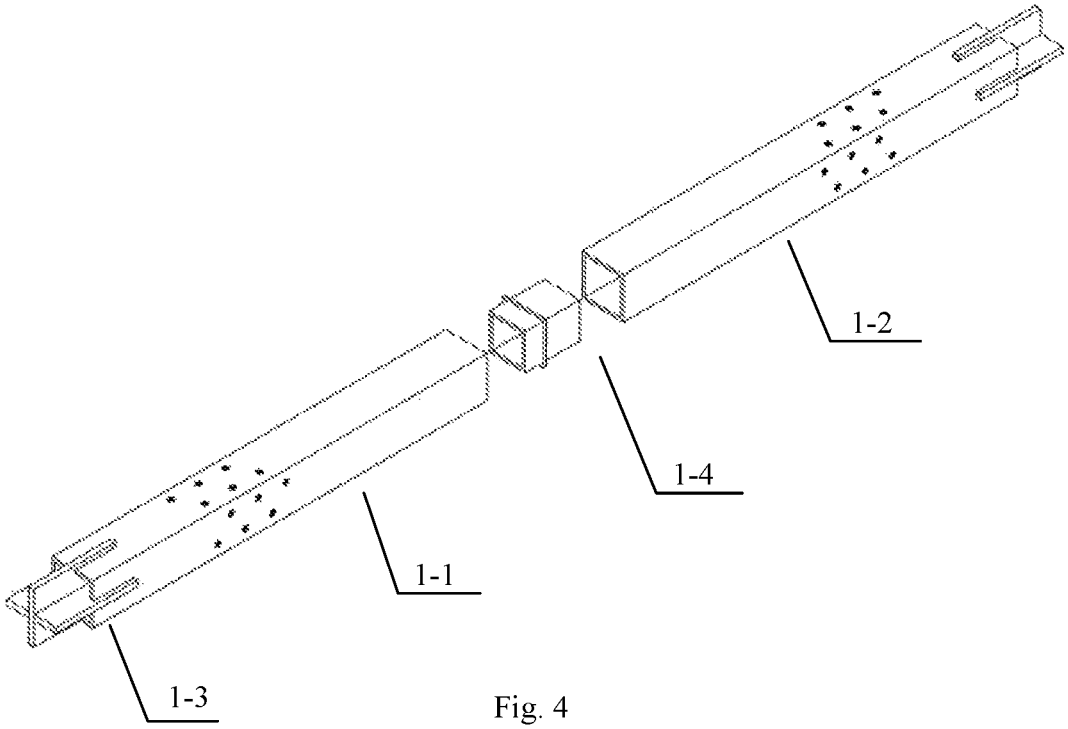
FIG. 4 is a schematic view illustrating a first embodiment of the inner restrained member of the present invention.
Figure 5:
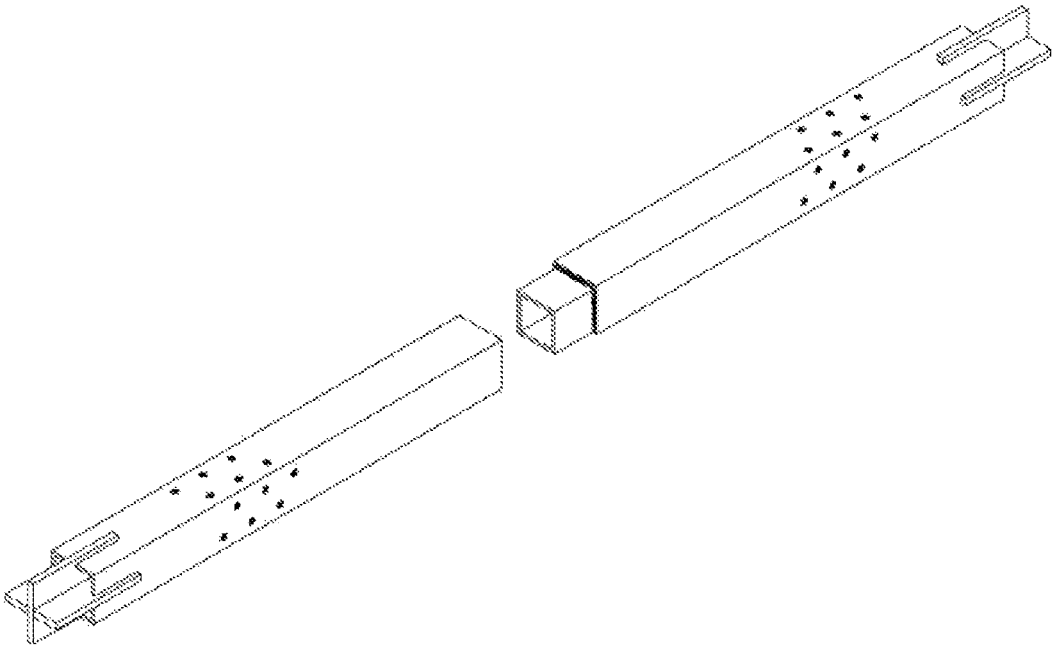
FIG. 5 is a schematic view illustrating a second embodiment of the inner restrained member of the present invention.
Figure 6:
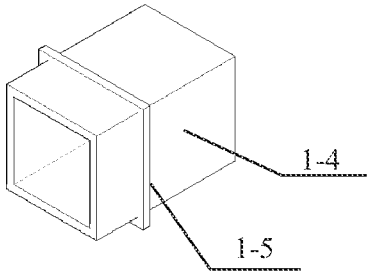
FIG. 6 is a schematic view illustrating the structure of a male-male adaptor of the inner restrained member of the present invention.
Figure 7A:
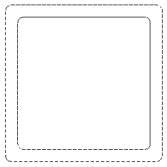
FIGS. 7A-7E are schematic views illustrating the composition forms of the male-male adaptor of the inner restrained member of the present invention.
Figure 7B:
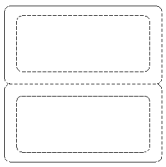
Figure 7C:
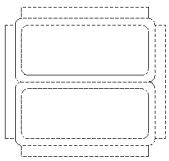
Figure 7D:
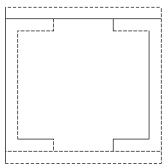
Figure 7E:
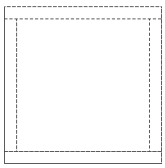

Further, the first steel square tube 1-1 and the second steel square tube 1-2 are preferably the same (i.e., the same length, thickness and outer section), and are made of the same material. As shown in FIGS. 4-6, the first steel square tube 1-1 and the second steel square tube 1-2 are connected through a male-male adaptor 1-4, the male-male adaptor 1-4 is a steel square tube, one end of the male-male adaptor 1-4 is welded to or plugged into the first steel square tube 1-1, and the other end is plugged into the second steel square tube 1-2, when the male-male adaptor 1-4 is plugged into the first steel square tube 1-1, stiffeners 1-5 which are arranged on the outside surface and perpendicular to the planes of the steel square tubes are preferably arranged at the middle part of the male-male adaptor 1-4 (not required during welding), so as to prevent the male-male adaptor 1-4 into the first steel square tube 1-1 or the second steel square tube 1-2; it is worth noting that the outer dimension of the stiffeners 1-5 does not exceed the outermost dimension of the first steel square tube 1-1 or the second steel square tube 1-2, so that the installation of the L-shaped energy dissipation element is not affected; the outer section size of the male-male adaptor 1-4 is smaller than the inner section sizes of the first steel square tube 1-1 and the second steel square tube 1-2, thereby not only ensuring that the second steel square tube 1-2 and the male-male adaptor 1-4 can slide freely relative to each other, but also ensuring that the first steel square tube 1-1 and the second steel square tube 1-2 have a relatively effective inner restrained effect on the L-shaped energy dissipation element. Furthermore, the first steel square tube 1-1 and the second steel square tube 1-2 may be 100-5000 mm long, and the spacing between the first steel square tube 1-1 and the second steel square tube 1-2 is 20-500 mm after the installation, namely the distance between the near ends of the first steel square tube 1-1 and the second steel square tube 1-2 needs to meet the maximum design tensile/compression resistance deformation requirements of the buckling-restrained brace; the gap between the outside surface of the male-male adaptor 1-4 and the inside surface of the second steel square tube 1-2 is preferably 1-10 mm so as to ensure that the male-male adaptor 1-4 and the second steel square tube 1-2 can slide freely; and the male-male adaptor 1-4 inserted into the second steel square tube 1-2 is preferably 20-800 mm long, so as to prevent the male-male adaptor 1-4 from departing from the second steel square tube 1-2 when the buckling-restrained brace is in tension.

It should be noted that, as shown in FIGS. 7A-7E, the steel square tube of the male-male adaptor 1-4 can be a steel tube which is integrally formed, formed by welding two square tubes or formed by welding steel plates and section steel or formed in a variety forms, as long as the design requirements are met.

Figure 9:
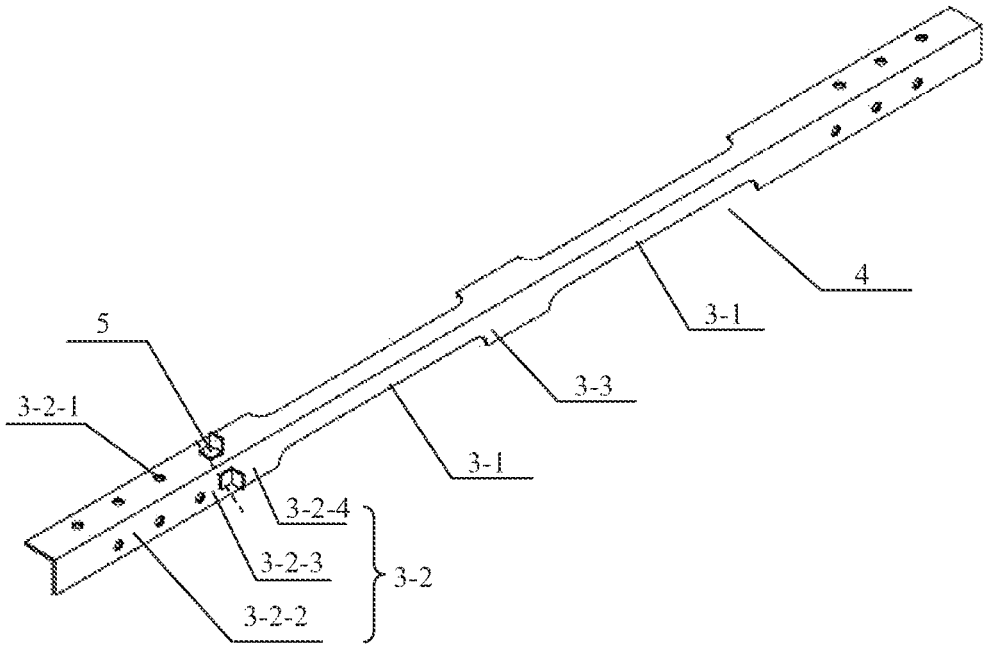
FIG. 9 is a perspective view illustrating an L-shaped fuse of the present invention.

Preferably, as shown in FIG. 9, bolt holes 3-2-1 for connection with the first steel square tube 1-1 and the second steel square tube 1-2 are formed in the outer sides of the non-yielding segments 3-2. Each non-yielding section 3-2 includes an unrestrained connection section 3-2-2 provided with the bolt holes 3-2-1, an unrestrained non-yielding segment 3-2-3 not provided with the bolt holes 3-2-1 and not covered with the outer restrained member 2 and a restrained non-yielding segment 3-2-4 not provided with the bolt holes 3-2-1 but covered with the outer restrained member 2; the outer restrained member 2 covers the yielding segments 3-1 and the restrained non-yielding segments 3-2-4, the dotted line in FIG. 9 is a position where the outer restrained member 2 covers the L-shaped fuses 3; the unrestrained non-yielding segment 3-2-3 is arranged on the left of the dotted line, the restrained non-yielding segment 3-2-4 is arranged on the right of the dotted line, and the yielding segments 3-1 are restrained yielding segments restrained by the inner restrained member 1 and the outer restrained member 2. It is worth noting that each restrained non-yielding segment 3-2-4 should be long enough, so that the buckling-restrained brace does not disengage from the restraint of the outer restrained member 2 completely when being deformed by a maximum design tension capacity; and the length of each unrestrained non-yielding segment 3-2-3 should be appropriate so as to ensure that there is still a distance between the ends of the unrestrained connection segment 3-2-2 and the outer restrained member 2 when the buckling-restrained brace deforms by a maximum design compressive bearing capacity.

Figure 11A:
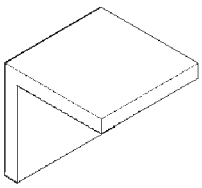
FIGS. 11A and 11B are schematic views illustrating different structures of a lifting piece of the present invention.
Figure 11B:
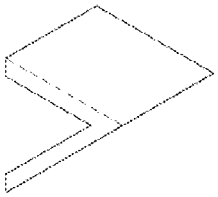

Preferably, lifting pieces 5 used for lifting the outer restrained member 2 are fixedly arranged at the unrestrained non-yielding segment 3-2-3 in the lower parts of the L-shaped fuses 3; the lifting pieces 5 may be fixedly connected with the L-shaped fuses 3 by welding and in other ways; a plurality of lifting pieces 5 are provided, and are positioned in the same plane vertical to the lengthwise direction of the L-shaped fuses, as shown in FIGS. 11A and 11B, the lifting pieces 5 are angle iron or V-shaped plates, FIG. 11A shows angle iron and FIG. 11B shows a V-shaped plate; during the installation, if each lifting piece is the angle iron, a right-angle side of the angle iron is preferably welded in the lower parts, and the other right-angle side is used for lifting the outer restrained member; if each lifting piece is the V-shaped plate, ends of the V-shaped plate are welded in the lower parts; lifting pieces 5 are positioned at the bottom of the L-shaped fuses, and the plurality of lifting pieces 5 bear the gravity of the outer restrained member together to prevent the outer restrained member from sliding downwards; and the specific quantity of the lifting pieces 5 may be configured according to the actual condition.

As the male-male adaptor 1-4 has small section size and a poor restrained effect at the spacing between the first steel square tube 1-1 and the second steel square tube 1-2 of the inner restrained member 1, the non-weakened non-yielding segments are preferably arranged in the middle parts of the yielding segments 3-1 of the L-shaped fuses 3 for forming middle restrained non-yielding segments 3-3; the length of each of the middle restrained non-yielding segments 3-3 is greater than the spacing between the first steel square tube 1-1 and the second steel square tube 1-2 when the buckling-restrained brace deforms by the maximum design tension capacity, so as to reduce the stress intensity and damage intensity here, thus controlling the plastic damage within the restrained yielding segments, which avoids high stress and damage concentration here caused by the premature occurrence of local buckling deformation, resulting in the premature fracture of the L-shaped energy dissipation element.

Each L-shaped fuse 3 sequentially includes the unrestrained connecting segment 3-2-2, the unrestrained non-yielding segment 3-2-3, the restrained non-yielding segment 3-2-4, the restrained yielding segment, the middle restrained non-yielding segment 3-3, the restrained yielding segment, the restrained non-yielding segment 3-2-4, the unrestrained non-yielding segment 3-2-3 and the unrestrained connecting segment 3-2-2 from one end to the other end.

In the present invention, the outer restrained member 2 has a restraint function to the L-shaped energy dissipation element; there are various structural forms of the outer restrained member 2, and some of them are described as follows:

Embodiment 1

Figure 12:
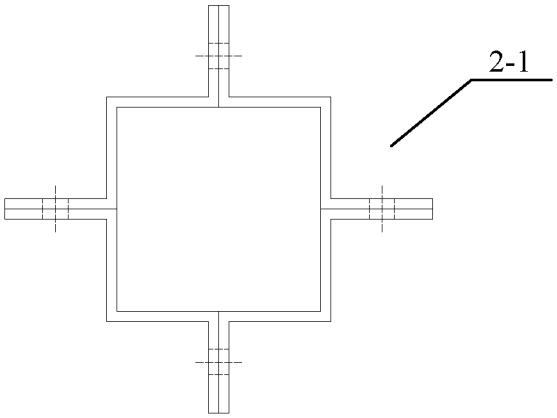
FIG. 12 is a sectional schematic view of embodiment 1 of an outer restrained member of the present invention.

A shown in FIG. 12, the outer restrained member 2 is formed by buckling four W-shaped steel plates 2-1, and the adjacent W-shaped steel plates 2-1 are connected by the bolts to form a square tubular structure finally to be covered outside the L-shaped energy dissipation element. Preferably, if each of the L-shaped fuses 3 changes in thickness, but the same set of outer restrained member is still required for use, washers with appropriate thickness are added to fit the L-shaped fuses of different thicknesses when the four W-shaped steel plates 2-1 are connected by the bolts in pairs.

Embodiment 2

Figure 13:
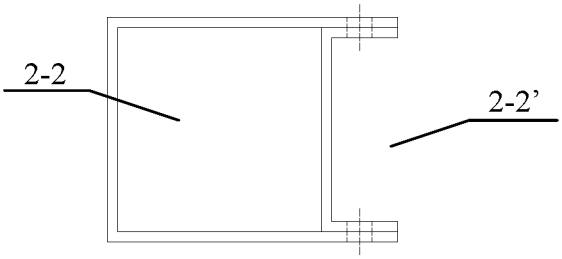
FIG. 13 is a sectional schematic view of embodiment 2 of the outer restrained member of the present invention.

As shown in FIG. 13, the outer restrained member 2 is formed by connecting two U-shaped steel plates 2-2 and 2-2' which open in the same direction by the bolts to form a square tubular structure finally to be covered outside the L-shaped energy dissipation element.

Embodiment 3

Figure 14:
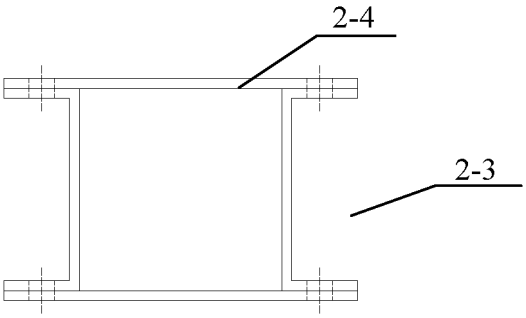
FIG. 14 is a sectional schematic view of embodiment 3 of the outer restrained member of the present invention.

As shown in FIG. 14, the outer restrained member 2 includes two U-shaped steel plates 2-3 which are arranged opposite with each other and open in the opposite direction, and two steel plates 2-4 are connected on the side faces of the U-shaped steel plates 2-3 by the bolts, the two steel plates 2-4 and a pair of U-shaped steel plates 2-3 form a square tubular structure to be covered outside the L-shaped energy dissipation element.

Embodiment 4

Figure 15:
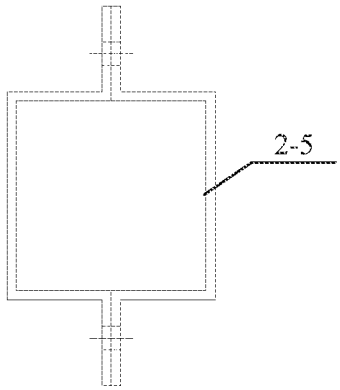
FIG. 15 is a sectional schematic view of embodiment 4 of an outer restrained member of the present invention.
Figure 16A:
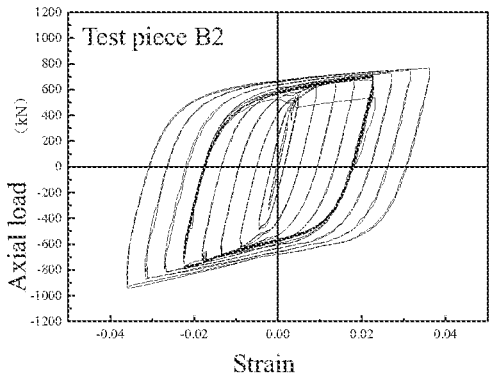
FIGS. 16A-16F show hysteretic curves of specimens B1 to B6, respectively.
Figure 16B:
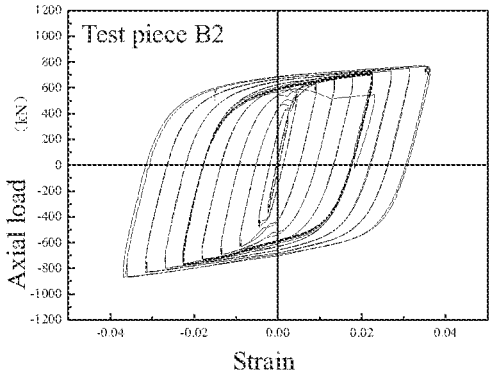
Figure 16C:
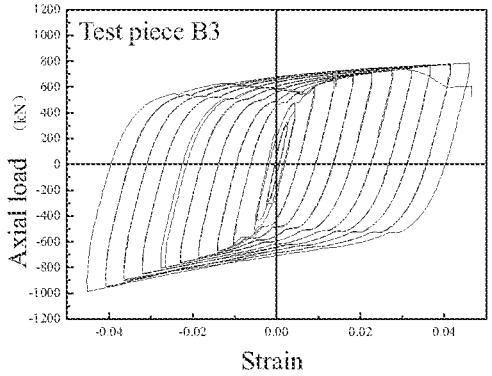
Figure 16D:
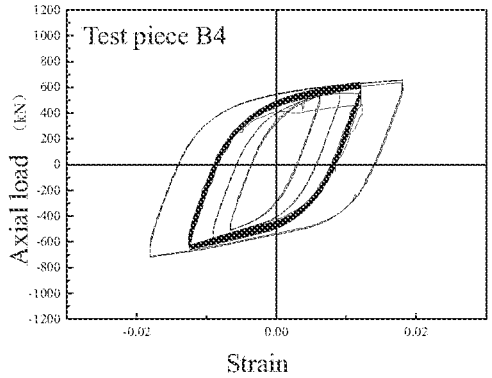
Figure 16E:
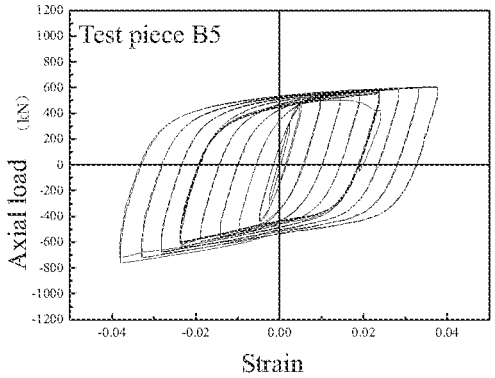
Figure 16F:
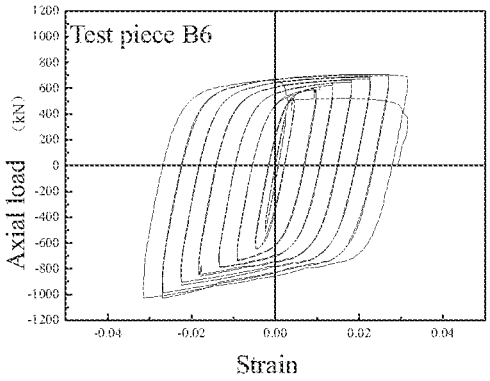

As shown in FIG. 15, the outer restrained member 2 is formed by buckling two U-shaped steel plates 2-5, and the buckling point between the U-shaped steel plates 2-5 is connected by the bolts.

The sequence of the above embodiments is only for the convenience of description, instead of representing the priority of the embodiments, and the outer restrained member 2 in the above embodiments is connected by the bolts respectively, which is simple to disassemble; furthermore, the outer restrained member should be consistent with the designed length of the restrained yielding segments, thus ensuring that the restrained yielding segments do not stretch out the outer restrained member in any case (especially bear the maximum design tension capacity).

As an improvement of the present invention, the gap between the outer restrained member 2 and the L-shaped energy dissipation element is 1-5 mm, a debonding material is preferably filled in the gap; the debonding material can be lubricating oil, soft glass or Teflon material and the like, and can also be selected flexibly according to specific situations, moreover, the non-bonding material can reduce the friction force between the L-shaped energy dissipation element and the inner restrained member 1 and between the L-shaped energy dissipation element and the outer restrained member 2 when the high-order buckling deformation of the L-shaped energy dissipation element occurs.

Figure 10:
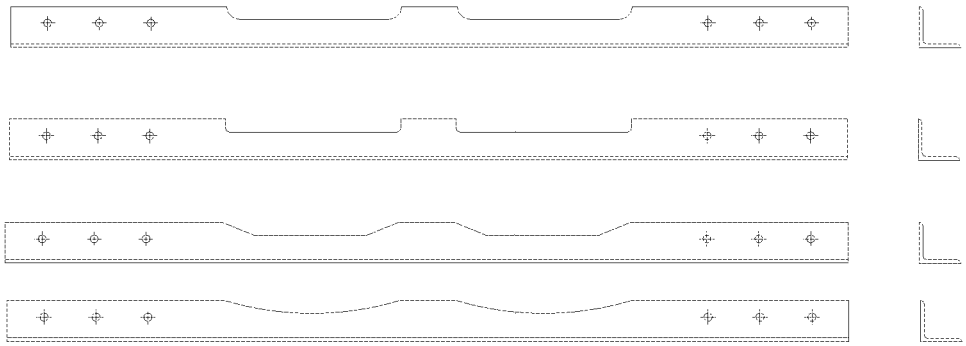
FIG. 10 is a side view illustrating different structural forms of the L-shaped fuse of the present invention.

As another improvement of the present invention, as shown in FIG. 10, there are various forms of the L-shaped fuses 3; transition regions between the adjacent two sections of the restrained non-yielding segments 3-2-4, the restrained yielding segments and the middle restrained non-yielding segments 3-3 are arc lines, straight lines or a combination thereof.

In a further aspect, the present invention provides a building including the above buckling-restrained brace with the L-shaped energy dissipation element. As the structure is the same as the structure above, it will not be repeated herein.

In still a further aspect, the present invention further provides an assembly method of the above buckling-restrained brace with the L-shaped energy dissipation element, including:

step 1: welding or plugging one end of the male-male adaptor 1-4 to the first steel square tube 1-1 (during welding, prefabricated in a factory), and plugging the other end into the second steel square tube 1-2 to form the inner restrained member 1;

step 2: adjusting the spacing between the first steel square tube 1-1 and the second steel square tube 1-2, and connecting the unrestrained connecting segments 3-2-2 of 4 L-shaped energy dissipation elements to the right-angle sides of each of the first steel square tube 1-1 and the second steel square tube 1-2;

step 3: covering the L-shaped energy dissipation element by the outer restrained member 2, and connecting the components of the outer restrained member 2 by the bolts.

The buckling-restrained brace with the L-shaped energy dissipation element of the present invention undergoes performance tests according to Shanghai Engineering Construction Standard Code for Design of High-rise Building Steel Structures (DG/TJ08-32-2008) (referred to as Shanghai high steel code), Code for Seismic Design of Buildings (GB50011-2010) (referred to as seismic code), Shanghai Recommended Application Standard of Building Products, Application Technology Code for TJ Buckling-restrained Braces (DBJ/CT105-2011) (referred to as TJ restrained brace code) and Technical Specification for Seismic Energy Dissipation of Buildings (JGJ297-2013) (referred to as energy dissipation code), and the tests are specifically as follows:

In the seismic code, the net length of the brace is defined as L; in the Shanghai high steel code and the TJ restrained brace code, strength degradation of the test pieces are required to be not more than 15% in three tensile and compressive tests at the displacement amplitudes of L/300, L/200, L/150 and L/100 in sequence; and in the seismic code, the energy dissipation code and the TJ restrained brace code, the strength degradation of the test pieces are required to be not more than 15% in 30 cycles at the displacement amplitude of L/150.

TABLE 1

| Number of specimens | Total length of two yielding segments (mm) | Width of yielding segments (mm) | Debonding material | Steel model | CPD | Maximum compression/tension ratio β |
|---|---|---|---|---|---|---|
| B1 | 890 | 45 | Lubricating oil | Q235 | 1220 | 1.23 |
| B2 | 890 | 45 | Soft glass | Q235 | 1166 | 1.13 |
| B3 | 890 | 45 | Lubricating oil | Q235 | 1100 | 1.26 |
| B4 | 1000 | 45 | Lubricating oil | Q235 | 2214 | 1.14 |
| B5 | 850 | 35 | Lubricating oil | Q235 | 1053 | 1.26 |
| B6 | 890 | 45 | Lubricating oil | LY225 | 852 | 1.26 |

The basic parameters of the buckling-restrained brace with the L-shaped energy dissipation element are listed in Table 1. In the tests, it was assumed that the total length of the restrained yielding segments was 0.56 times the length of the brace. 30 cycles of constant amplitude loading with the displacement amplitude corresponding to L150 and incremental loading (increased once every three circles) with the displacement amplitudes sequentially corresponding to L/300, L/200, L/150 and L/100 were sequentially applied to the specimen B4. In constant amplitude loading process, the tensile strength degradation was 3.6% and the compressive strength degradation was 5%, and the compressive strength met the requirement of being within 15%. In the variable amplitude loading process, no obvious (more than 15%) strength and stiffness degradation occurred, meeting the requirements of the code.

In Table 1, the cumulative plastic deformation (CPD) of each specimen was calculated according to the American Standard AISC 341-16 (AISC 2016), and the cumulative plastic deformation of each specimen exceeded the recommended lower limit of 200 given in AISC 341-16 (AISC 2016), wherein the CPD of the specimen B4 reached 2214.

In Table 1, the maximum compression/tension ratio β of each specimen was less than the upper limit 1.3 specified by AISC 341-16, being in line with the requirements of the code.

Moreover, as shown in FIGS. 16A-16F are the hysteretic curves of the specimens B1-B6 respectively. It can be seen that the hysteretic curves of the specimens are relatively full without pinching, and show the similar stable hysteretic performance, which reveals that overall buckling did not occur. In addition, the inner restrained member and the outer restrained member were recycled in the specimens B1-B6 in the above test researches and no significant damage occurred at all.

The above is a preferred embodiment of the present invention. It should be noted that, those skilled in the art can also make a number of improvements and modifications without departing from the principles of the present invention, and the improvements and modifications should also be regarded as being within the protection scope of the present invention.

The invention claimed is:

1. A buckling-restrained brace with an L-shaped energy dissipation element used as a brace for a frame, the buckling-restrained brace comprising a telescopic inner restrained member, an outer restrained member sleeved outside the inner restrained member and the L-shaped energy dissipation element between the inner restrained member and the outer restrained member, wherein:

the inner restrained member comprises a first steel square tube and a second steel square tube with the same length and outer section, the first steel square tube and the second steel square tube are connected by insertion, and far ends of the first steel square tube and the second steel square tube are configured to be connected with the frame;

the L-shaped energy dissipation element comprises four L-shaped fuses including limbs, and two ends of each of the four L-shaped fuses are connected to four right-angle sides of the first steel square tube and the second steel square tube by bolts, respectively; two slots or two notches are formed in a middle part of each of the limbs of the L-shaped fuses for forming weakened yielding segments, and the two ends of each of the four L-shaped fuses are non-weakened non-yielding segments; and an inner section of the outer restrained member is square, the outer restrained member covers the L-shaped energy dissipation element, and a gap is disposed between the outer restrained member and the L-shaped energy dissipation element.

2. The buckling-restrained brace according to claim 1, wherein:

the first steel square tube and the second steel square tube have the same size, the first steel square tube and the second steel square tube are connected by a male-male adaptor, the male-male adaptor is a steel square tube, a stiffener is arranged on an outside surface of the male-male adaptor at a middle part thereof, and is perpendicular to planes of the steel square tube of the male-male adaptor, an outer section of the male-male adaptor is smaller than an inner section of the first steel square tube, one end of the male-male adaptor is welded or plugged into the first steel square tube, and an other end is plugged into the second steel square tube.

3. The buckling-restrained brace according to claim 2, wherein:

each of the first steel square tube and the second steel square tube is 100-5000 mm long, a spacing between the first steel square tube and the second steel square tube is 20-500 mm, a gap between the outside surface of the male-male adaptor and an inside surface of the second steel square tube is 1-10 mm, and the male-male adaptor plugged into the second steel square tube is 20-800 mm long.

4. The buckling-restrained brace according to claim 2, wherein:

bolt holes for connection of the first steel square tube and the second steel square tube are formed in outer side parts of the non-yielding segments, each non-yielding segment comprises an unrestrained connection segment provided with the bolt holes, an unrestrained non-yielding segment not provided with the bolt holes and not covered with the outer restrained member, and a restrained non-yielding segment not provided with the bolt holes but covered with the outer restrained member;

the outer restrained member covers the yielding segments and the restrained non-yielding segments, and the yielding segments are restrained yielding segments restrained by the inner restrained member and the outer restrained member.

5. The buckling-restrained brace according to claim 4, wherein:

lifting pieces configured to lift the outer restrained member are fixedly arranged at the unrestrained non-yielding segment on the limbs in lower parts of the L-shaped fuses;

the L-shaped fuses further comprise a middle non-weakened non-yielding segment arranged in the middle part of each of the limbs in between the weakened yielding segments formed by the two slots or two notches of the L-shaped fuses for forming middle restrained non-yielding segments, and a length of each of the middle restrained non-yielding segments is larger than a spacing between the first steel square tube and the second steel square tube when the buckling-restrained brace deforms by a maximum design tension capacity.

6. The buckling-restrained brace according to claim 5, wherein:

the outer restrained member is formed by buckling four W-shaped steel plates, and adjacent W-shaped steel plates are connected by the bolts; or the outer restrained member is formed by connecting two U-shaped steel plates which open in the same direction by the bolts; or the outer restrained member comprises two U-shaped steel plates which are arranged opposite with each other and open in an opposite direction, and two steel plates are connected on a side surface of the U-shaped steel plates by the bolts; or the outer restrained member is formed by buckling two U-shaped steel plates, and the two U-shaped steel plates are connected by the bolts.

7. The buckling-restrained brace according to claim 6, wherein the gap between the outer restrained member and the L-shaped energy dissipation element is 1-5 mm, and a debonding material is filled in the gap.

8. The buckling-restrained brace according to claim 7, wherein transition regions of two adjacent segments of the restrained non-yielding segments, the restrained yielding segments and the middle restrained non-yielding segments are arc lines, straight lines or a combination thereof.

9. A building, comprising the buckling-restrained brace with the L-shaped energy dissipation element according to claim 1.

10. An assembly method of the buckling-restrained brace with the L-shaped energy dissipation element according to claim 8, comprising:

step 1: welding or plugging one end of the male-male adaptor to or into the first steel square tube, and plugging the other end into the second steel square tube to form the inner restrained member;

step 2: adjusting the spacing between the first steel square tube and the second steel square tube, and connecting the unrestrained connection segments of the L-shaped energy dissipation element to the right-angle sides of each of the first steel square tube and the second steel square tube by the bolts; and step 3: covering the L-shaped energy dissipation element by the outer restrained member, and connecting components of the outer restrained member by the bolts.

11. A building, comprising the buckling-restrained brace with the L-shaped energy dissipation element according to claim 2.

12. A building, comprising the buckling-restrained brace with the L-shaped energy dissipation element according to claim 3.

13. A building, comprising the buckling-restrained brace with the L-shaped energy dissipation element according to claim 4.

14. A building, comprising the buckling-restrained brace with the L-shaped energy dissipation element according to claim 5.

15. A building, comprising the buckling-restrained brace with the L-shaped energy dissipation element according to claim 6.

16. A building, comprising the buckling-restrained brace with the L-shaped energy dissipation element according to claim 7.

17. A building, comprising the buckling-restrained brace with the L-shaped energy dissipation element according to claim 8.

18. A buckling-restrained brace with an L-shaped energy dissipation element used as a brace for a frame, the buckling-restrained brace comprising a telescopic inner restrained member, an outer restrained member sleeved outside the inner restrained member and the L-shaped energy dissipation element between the inner restrained member and the outer restrained member, wherein:

the inner restrained member comprises a first steel square tube and a second steel square tube with the same length and outer section, the first steel square tube and the second steel square tube are connected by insertion, and far ends of the first steel square tube and the second steel square tube are configured to be connected with the frame;

the L-shaped energy dissipation element comprises four L-shaped fuses including limbs, and two ends of each of the four L-shaped fuses are connected to four right-angle sides of the first steel square tube and the second steel square tube by bolts, respectively; two slots or two notches are formed in a middle part of each of the limbs of the L-shaped fuses for forming weakened yielding segments, and the two ends of each of the four L-shaped fuses are non-weakened non-yielding segments; and an inner section of the outer restrained member is square, and the outer restrained member covers the L-shaped energy dissipation element.

* * * * *